United States Patent [19]

Gebert

[11] Patent Number: 4,483,033

[45] Date of Patent: Nov. 20, 1984

[54] SERVICE DEVICE FOR THE INTERIOR VIEWING SURFACE OF A SIMULATOR DOME

[75] Inventor: Frank X. Gebert, Vestal, N.Y.

[73] Assignee: The Singer Company, Binghamton, N.Y.

[21] Appl. No.: 451,982

[22] Filed: Dec. 21, 1982

[51] Int. Cl.[3] ..... E04G 3/14

[52] U.S. Cl. ..... 15/3; 15/49 R; 182/36

[58] Field of Search ..... 15/1, 3, 49 R, 50 R, 15/98; 182/36, 37, 39

[56] References Cited

U.S. PATENT DOCUMENTS 3,870,122 3/1975 Faucheux ..... 182/36

3,960,242 6/1976 Saxonmeyer ..... 182/36

*Primary Examiner*—Edward L. Roberts

*Attorney, Agent, or Firm*—Douglas M. Clarkson

[57] ABSTRACT

The specification describes a device that admits of performing a variety of servicing, inspection and maintenance functions on the viewing surface of a simulator dome. The structural arrangement of such device includes a circular track supported by the base floor of the simulator and at least one arcuate carrier track extending from one end at the circular track, upwardly in a plane perpendicular to the circular track and at a constant distance from the viewing surface, to the opposite end at the circular track 180 degrees from the end. A servo unit, carrying a desired implement to perform some function on the viewing surface, is indexed along the arcuate carrier track after the arcuate carrier track is turned 360 degrees. Suitable wheels support each end of the arcuate carrier track on the circular track.

5 Claims, 3 Drawing Figures

SERVICE DEVICE FOR THE INTERIOR VIEWING SURFACE OF A SIMULATOR DOME

BACKGROUND OF THE INVENTION

The present invention, generally, relates to a projected-image visual systems with screens and/or mirrors having large radii for exhibiting projected images and, more particularly, to a light-weight structure for providing service to such screen or mirror interior viewing surface of a simulator dome.

As high performance aircraft become increasingly complex, the need for more extensive and specialized training increases also. Today's sophisticated flight and mission simulators trace their genealogy back to the first flight trainers developed by Edwin A. Link, Jr. in the 1930's, as illustrated in U.S. Pat. No. 1,825,462.

In the 1960's, flight simulator designers turned to digital computation techniques to solve the technical problems associated with the simulation of complex, high-performance aircraft, which proved to be a technological breakthrough, because it permitted the development of complete visual scenes by means of a computer. At this point in time, it was the practice in the simulation industry to provide visuals by using cathode ray tubes positioned at each window of the simulated aircraft.

However, with the present-day aircraft, windows are much larger, and in some aircraft such as the F-16, a transparent bubble permits a pilot to view a scene from horizon to horizon, more than 180°. The decade of the 1970's has brought a new set of unique challenges to the flight simulation industry in its attempt to provide simulated visual scenes which match realistically the real world conditions.

Just before the end of the decade of the 1970's, a significant breakthrough was achieved in the provision of a first practical segmented dome structure, which is the subject of U.S. patent application Ser. No. 362,710 assigned to the same assignee as the present invention. Since that time, additional structures for the provision of a realistic dome-shaped visual screen for receiving a projection-type image have been suggested, most of which by the assignee of the present invention.

SUMMARY OF THE INVENTION

It is an object of the present invention to provide a service structure for servicing the interior viewing surface of a simulator dome.

It is also an object of the invention to provide a new and improved service structure adaptable equally to providing many of the tasks required both in erecting a segmented dome structure as well as in servicing the interior viewing surface of a simulator dome that has been in use for a period of time.

Briefly, a service structure in accordance with the present invention includes a circular track arranged on and supported by the base floor of the simulator dome. At least one, and preferrably two, arcuate carrier tracks are arranged with both ends supported rotatably on the circular track and extending upwardly in an arc at a substantially constant predetermined distance from the viewing surface of the dome. A servo-type unit is supported by this arcuate carrier track and may be indexed along its arcuate length to any desired position in order to place a predetermined implement, such as a cleaning brush, a vacuum nozzle, or the like for treating the viewing surface.

BRIEF DESCRIPTION OF THE DRAWINGS

The foregoing and other objects, features and advantages will appear more fully from the detailed description of the presently preferred embodiments of the invention and from the appended claims, both viewed in conjunction with the accompanying drawings, where:

PRESENTLY PREFERRED EMBODIMENTS

Figure 3:
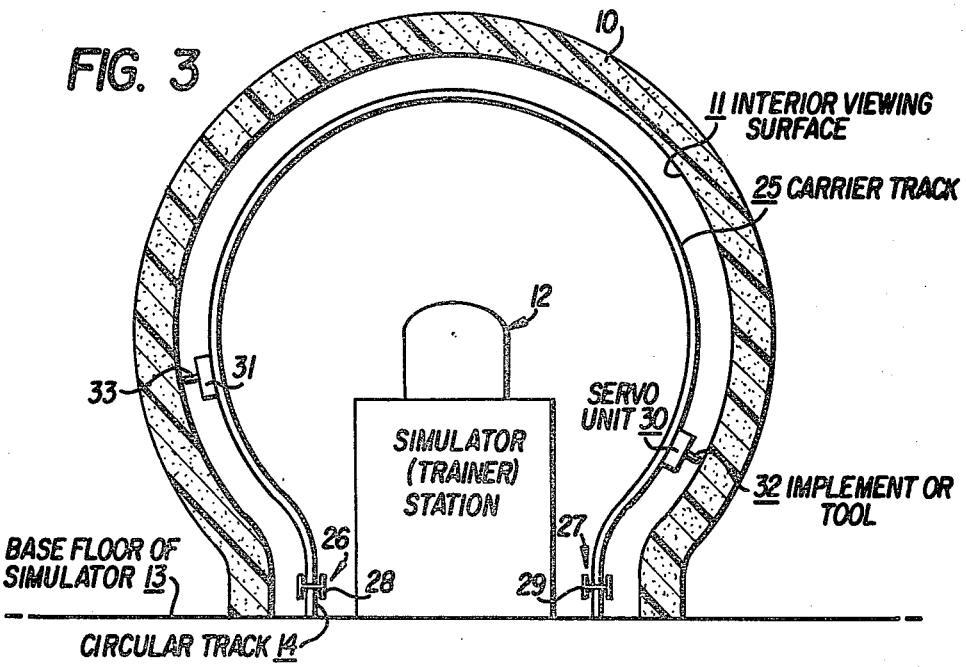
FIG. 3 is a view in elevation partly in cross section of a simulator dome structure with the arcuate carrier tracks and the circular track positioned in operable relationship to the interior viewing surface of the dome, in accordance with the present invention.

Referring first to FIG. 3 of the drawings, the reference numeral 10 identifies generally a simulation dome structure to provide an interior viewing surface 11 for a projected visual scene to be viewed by a simulator 12. The simulator dome 10 is constructed in any desired manner and is customarily supported by the same base floor 13 which supports the simulator 12.

Although such a dome structure has not been in use for very many years, already it has been found desirable to service the interior surface 11 from time to time. Examples of such a need is for cleaning, painting, or inspection, because any slight imperfection that develops is readily apparent because of the brightness of the illumination due to a projected image.

Heretofore, the only accepted way such a viewing surface could be serviced is by erecting a temporary type of scaffold. Such a scaffold is not satisfactory for several reasons not the least of which is the time it takes to erect a scaffold to permit inspection of all points on a dome surface many feet in the air, for example, in access of 20 feet in the air. During such prior servicing intervals, the simulator 12 must be shut down, and this means lost training time.

In accordance with the present invention, a circular track 14 is arranged on and is supported by the same base floor 13 which supports the simulator dome 10 and the simulator 12. The circular track 14 may be installed permanently, if desired, and left in place for periodic use, or alternatively, such a circular track 14 can be quickly mounted temporarily for occasional use.

Figure 1:
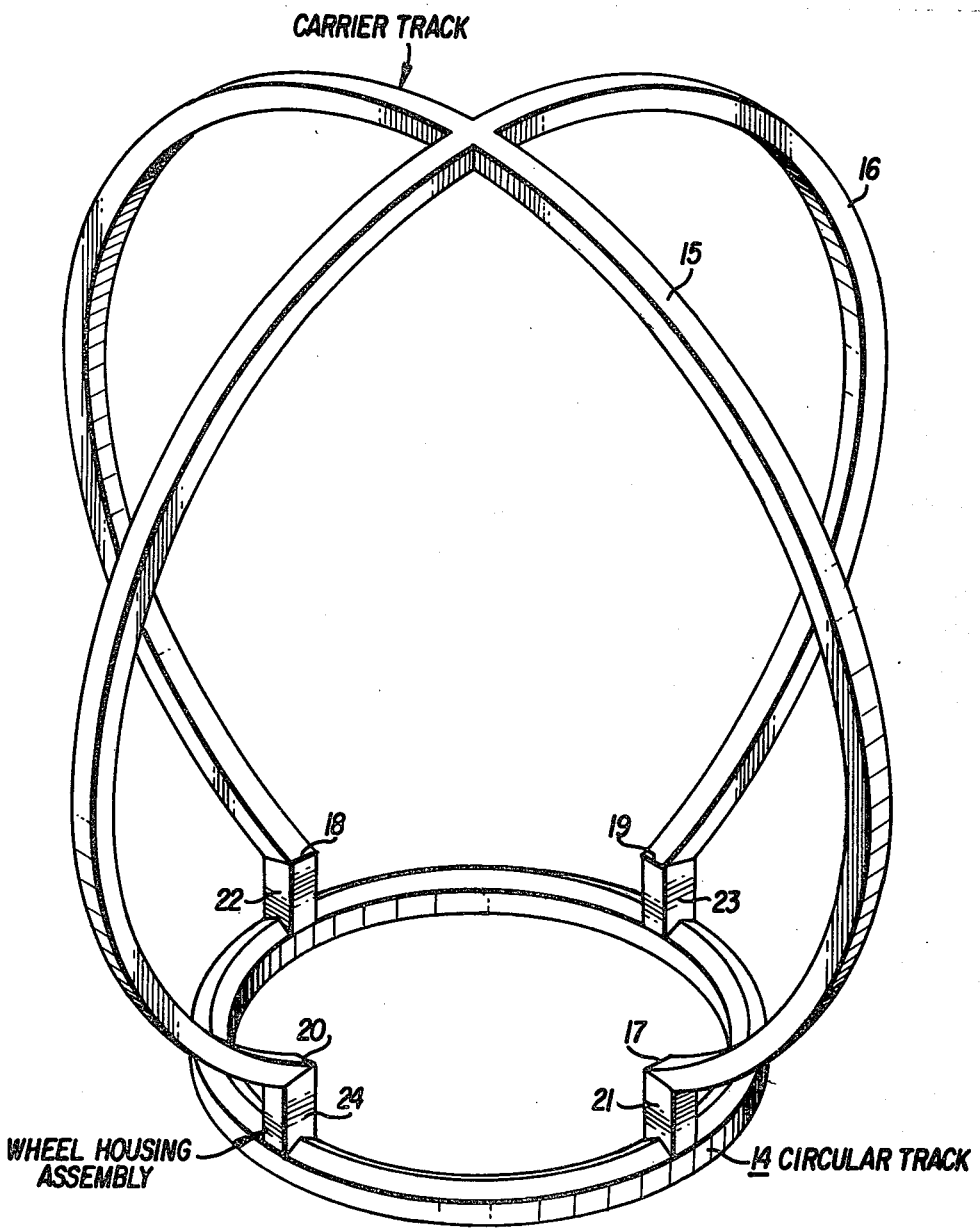
FIG. 1 is a perspective view showing two arcuate carrier tracks positioned substantially perpendicular to each other and in rotatable position relative to a circular track, in accordance with one aspect of the present invention.

As better seen in FIG. 1, the circular track 14 is illustrated in perspective, and two arcuate carrier tracks 15 and 16 are illustrated in perspective also. The arcuate carrier track 15 has one end 17 located at the circular track 14 and an opposite end 18 also located at the circular track 14 but at a point which is diametrically opposite.

Similarly, the arcuate carrier track 16 has one end 19 located at the circular track 14 with its opposite end 20 located at the circular track 14 but at a point diametrically opposite thereto.

Each of the ends 17, 18, 19, and 20 is supported on the circular track 14 by a suitable rolling member, indicated diagrammatically in FIG. 1 as wheel housing's 21, 22, 23 and 24, respectively.

In FIG. 3 of the drawings, a single arcuate carrier track 25 is illustrated. The carrier track 25 has one end 26 and an opposite end 27 with the intermediate portion of the carrier track 25 extending from the end 26 upwardly, substantially perpendicular to the circular track 14 mounted on the base floor 13, and maintaining a substantially constant predetermined distance from the interior viewing surface 11 of the dome 10, upwardly and around to the opposite end 27. The end 26 is illustrated by a diagrammatic rolling means 28, and the opposite end 27 is supported on the circular track 14 by a suitable rolling means 29, illustrated diagrammatically in this view.

At least one but preferably a plurality of servo units 30 and 31 are indexable upwardly, or downwardly, in a carefully control positioning operation, to locate them in a predetermined position along the arcuate carrier track 25. Each of the servo units 30 and 31 is adapted to carry an implement or tool 32 and 33, respectively, in order to accomplish a preselected treatment of the interior viewing surface 11 that may be desired.

Figure 2:
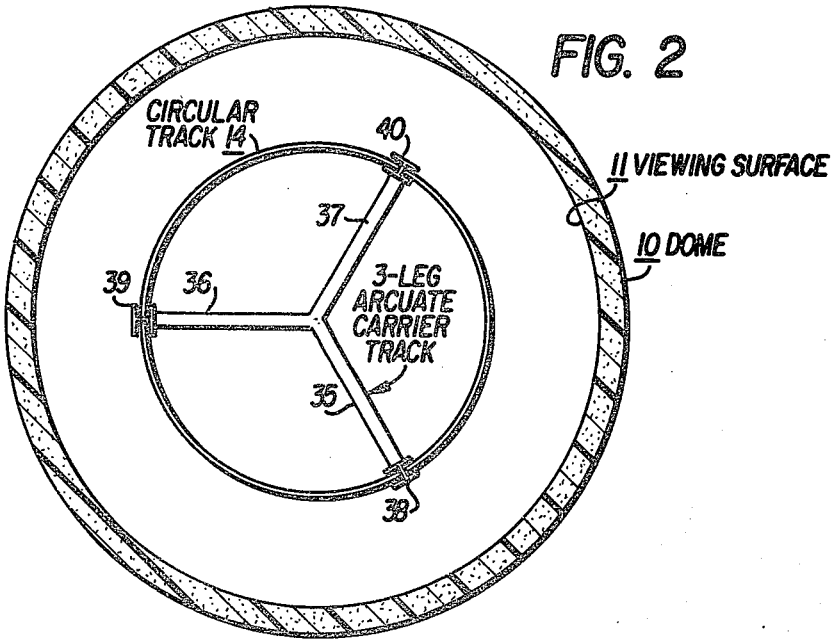
FIG. 2 is a top view in order to illustrate a modification of the arcuate carrier tracks in accordance with the invention.

In FIG. 2 of the drawings, a 3-leg arcuate carrier track is identified by the numeral 34. This arcuate carrier track 34 has three legs, identified by the reference numbers 35, 36 and 37, respectively.

The leg 35 of the arcuate carrier track 34 is supported on the circular track 14 by a suitable rolling member 38, and the other two legs 36 and 37 are similarly supported by rolling members 39 and 40, respectively.

A structure in accordance with the invention offers a relatively inexpensive means to accomplish a variety of operations in producing and/or in servicing the interior dome viewing surface in a closely controlled way. The previously described invention has the unique advantage of being useful in the construction of a dome-like structure after the centrally located simulator equipment has been erected. Another advantage is the closeness of supporting elements of the device to the components that perform the actual operation, for instance, the cutter or polishing head.

An outstanding advantage of the apparatus of the presently disclosed invention is its versatility with regard to the aiming of its use. The interior surface of a dome-like structure, notably a surface bearing a finish having an optical function such as a screen for motion picture display, requires periodical maintenance, cleaning or re-coating.

A structure in accordance with the present invention is easily erected and quickly dismantled after the required service has been performed. Further, mechanical and electrical means are provided to produce controlled movements of light-weight structure and servo units. The described structure may be equipped with one or more accessible work platforms which, as they rotate with the carrying structure, may be positioned in any location along the interior viewing surface. Thus, it is not necessary to build a complex all-around scaffold during the erection of a RIM dome, for example. By rotating the carrying structure, the platform or platforms may be moved along quickly and effortlessly into any desired position from which access to the viewing surface is desired.

Other modifications may occur to one skilled in the art, and therefore, the above detailed description of presently preferred arrangements are not to be taken as limiting. But rather, the present invention, both as to scope and as to the spirit thereof, is to be considered as limited only by the claims appended hereto.

I claim:

1. A service structure for the interior viewing surface of a simulator dome, comprising:

a circular track arranged on and supported by a base floor that supports said simulator dome the inner surface of which is arranged to provide a smooth, uninterrupted viewing surface for viewing, from a simulator training station, a scene projected thereon, at least one arcuate carrier track arranged to begin from one end at said circular track extending in a direction substantially perpendicular to said circular track and at a substantially constant predetermined distance from said viewing surface to terminate at its opposite end at said circular track, means disposed between said one end of said arcuate carrier track and said circular track and between said opposite end of said arcuate carrier track and said circular track to permit said arcuate carrier track to be turned at least a full 360 degrees, a servo unit adapted to be supported by said arcuate carrier track and to be indexed along its arcuate length uninterrupted from said one end to said opposite end, and said servo unit being formed to support a predetermined implement for performing a desired task on said viewing surface while an operator remains on said base floor, so that a preselected treatment of said interior viewing surface is accomplished.

2. A service structure for the interior viewing surface of a simulator dome in accordance with claim 1 including a second arcuate carrier track arranged substantially perpendicular to said one arcuate carrier track and having substantially the same means to permit the second arcuate carrier track to be turned with said one arcuate carrier track.

3. A service structure for the interior viewing surface of a simulator dome in accordance with claim 2 including at least two servo units supported by each of said arcuate carrier tracks.

4. A service structure for the interior viewing surface of a simulator dome in accordance with claim 3 wherein said implement supported by said servo units is a work platform.

5. A service structure for the interior viewing surface of a simulator dome in accordance with claim 1 wherein said one arcuate carrier track is arranged with an additional arcuate carrier track leg joined to said one arcuate carrier track at its highest point above said circular track to form a three-legged arcuate carrier track with each leg separated from the others by approximately 120 degrees.

* * * * *